US006119878A

United States Patent [19]

Zen

[11] Patent Number: 6,119,878

[45] Date of Patent: Sep. 19, 2000

[54] SUPPORT AND ATTACHMENT WALL MOUNT ASSEMBLY

[76] Inventor: Vic De Zen, 300 Greenbrook Drive, Woodbridge, Ontario, Canada, L4L 8Z7

[21] Appl. No.: 09/385,410

[22] Filed: Aug. 30, 1999

[30] Foreign Application Priority Data

Aug. 27, 1998 [CA] Canada ..... 2245809

[51] Int. Cl.[7] ..... A47F 5/00

[52] U.S. Cl. ..... 211/94.01; 211/57.1; 211/87.01; 248/222.51; 248/225.11

[58] Field of Search ..... 211/94.01, 87.01, 211/106, 57.1, 59.1; 248/222.51, 225.11

[56] References Cited

U.S. PATENT DOCUMENTS

| | | | |
|---|---|---|---|
| 1,800,387 | 4/1931 | Greist . | |
| 3,337,172 | 8/1967 | Jackson . | |
| 4,308,961 | 1/1982 | Kunce | 211/57.1 X |
| 4,678,151 | 7/1987 | Radek | 211/94.01 X |
| 4,817,900 | 4/1989 | Whittington et al. | 248/225.11 |
| 5,101,989 | 4/1992 | Jones | 211/94.01 |
| 5,109,993 | 5/1992 | Hutchison | 211/87.01 |
| 5,185,971 | 2/1993 | Johnson | 211/94.01 X |
| 5,228,579 | 7/1993 | Kaufman | 211/94.01 |
| 5,944,203 | 8/1999 | Vlah | 211/87.01 X |

*Primary Examiner*—Robert W. Gibson, Jr.

[57] ABSTRACT

In an assembly comprising a wall mountable support and an attachment which is held by the support, the attachment has a base with upper and lower legs which slide vertically into a mounting position with upper and lower leg receivers of the support. The base is then rockable relative to the support to position the base against a block which is provided on and which blocks release of the base from the support.

8 Claims, 3 Drawing Sheets

SUPPORT AND ATTACHMENT WALL MOUNT ASSEMBLY

FIELD OF THE INVENTION

The present invention relates to an assembly comprising a wall mount and an attachment supported by the wall mount.

BACKGROUND OF THE INVENTION

There are currently many different types of wall mount assemblies available on the market. One of these assemblies is in the form of an extended wall mount placed horizontally on the wall. The base of an attachment to be supported by the assembly can only be loaded in a horizontal direction into and then slides along the wall mount to move to a desired position. Once the attachment has reached the desired position, a securing screw or the like is used to hold it against further sliding.

Another type of wall mount and attachment assembly comprises an arrangement known as slot wall. Slot wall is often found in many different retail outlets.

Slot wall comprises vertically separated horizontally extending slots in a supporting wall for a hanger arm. The hanger arm has a base which loads by sliding downwardly into the slot wall.

Slot wall has the advantage that no horizontal sliding is required to load and properly position the hanger arm. However, the slot wall does suffer from the drawback that the hanger arm can easily be inadvertently knocked upwardly out of the slot wall.

SUMMARY OF THE INVENTION

The present invention provides a wall mountable support and attachment assembly in which the attachment is loaded in a vertical movement rather than having to slide along the support. The assembly then includes means which blocks the attachment from easily releasing upwardly from the support.

More particularly, in the assembly of the present invention, the attachment has a base with upper and lower legs which slide vertically into a mounting position with upper and lower leg receivers of the support. The base is then rockable relative to the support to position the base against blocking means which is provided on, and which blocks release of the base from, the support.

BRIEF DESCRIPTION OF THE DRAWINGS

The above as well as other advantages and features of the present invention will be described in greater detail according to the preferred embodiments of the present invention in which.

DETAILED DESCRIPTION ACCORDING TO THE PREFERRED EMBODIMENTS OF THE PRESENT INVENTION

Figure 1:
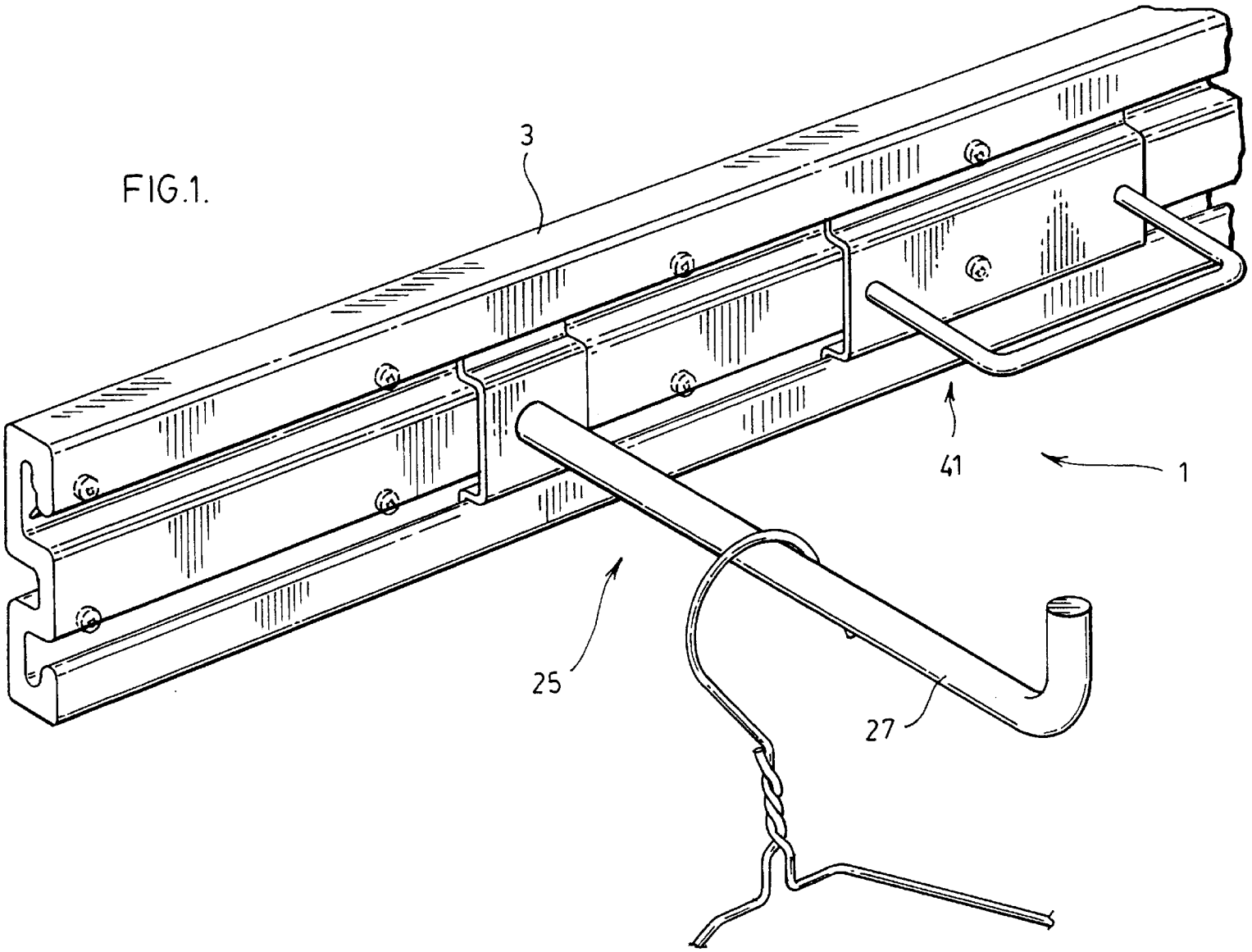
FIG. 1 is a perspective view of a wall support and attachment assembly according to a preferred embodiment of the present invention.

FIG. 1 shows an assembly generally indicated at comprising a wall mountable support 3 and different attachments which are held by the support. In this particular case, the attachments comprise a hook, generally indicated at 25, and a loop like member generally indicated at 41. It should be noted that the hook and the loop like member both have identical bases secured within the wall support 3.

The assembly shown in FIG. 1 can be put to many different uses such as, for example, within a clothing closet, or for example, within a garage or a utility shed to hold different types of tools.

In the preferred embodiment, the support 3 is made from a rigid plastic PVC foam. The use of such a foam makes the support very strong while at the same time giving it wall thickness for shaping the various different regions of the support to be described later in detail.

The attachment member including its base is preferably made from a metallic material which interacts extremely well with the foam construction of the support and once again makes the attachment itself very strong and durable.

Figure 3:
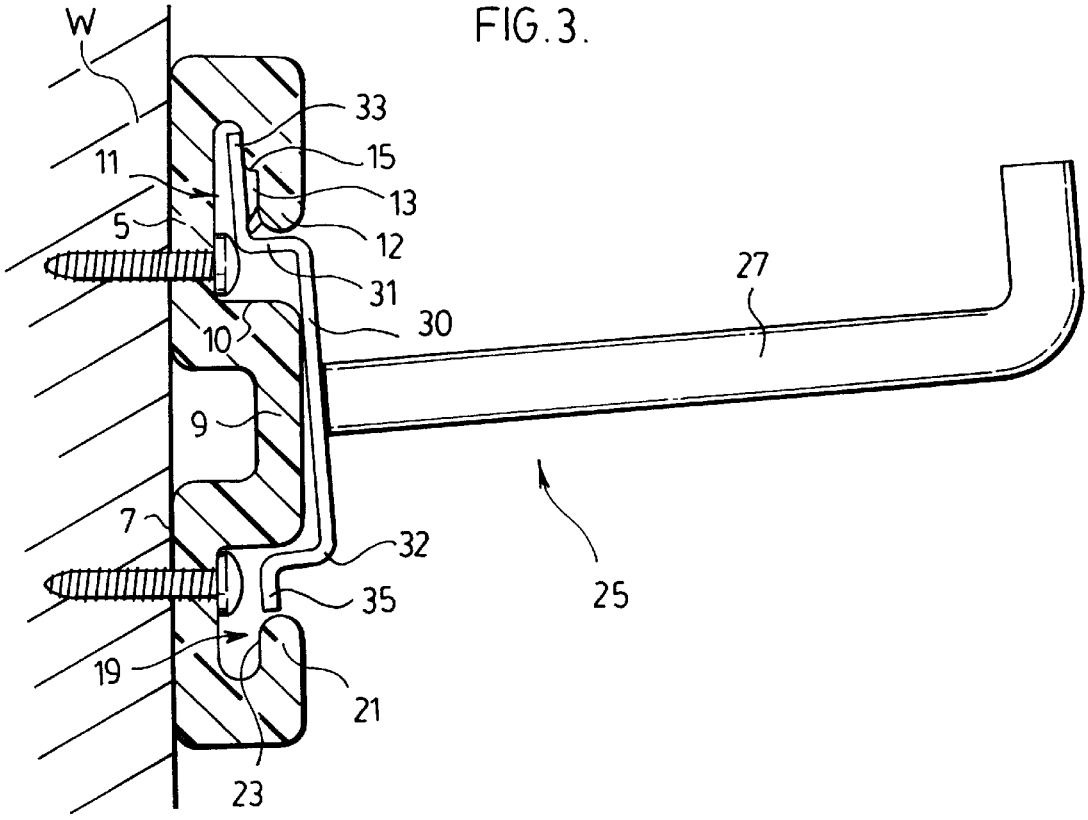
FIGS. 3 and 4 are end views of the assembly of FIG. 1 when mounted to a wall and showing the different steps of loading the attachment with the wall support.
Figure 4:
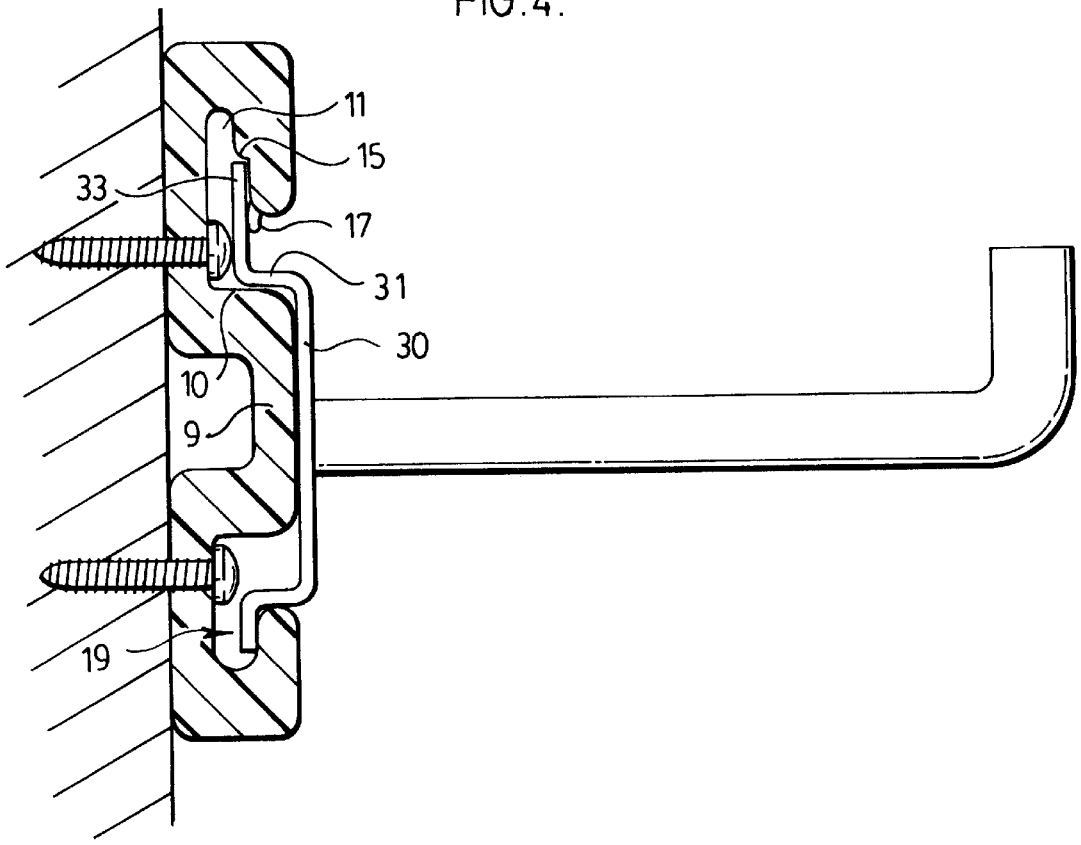

Support 3 is, as best shown in FIGS. 3 and 4 of the drawings, secured by fasteners such as screws and the like which pass directly through the support into a wall W. The support includes upper and lower flat backed walls 5 and 7 which lie flushly against the wall. A generally rectangular U-shaped wall region 9 extends forwardly of and between the two back walls 5 and 7 of the support.

Provided near the upper end of the support is a first pocket generally indicated at 11. A second pocket generally indicated at 19 is provided towards the lower end of the support. Pocket 11 has a pocket mouth 14 and pocket 19 has a pocket mouth 20 best seen in FIG. 2 of the drawings.

The upper pocket 11 includes a front wall 12 separated from the flat back wall 5 of the support by an undercut pocket region above the mouth 14 to the pocket 11.

The lower pocket has a front wall 21 below its mouth 20 and spaced forwardly of the rear wall region 7 by an undercut pocket region in the lower pocket.

The front wall 12 of the upper pocket includes a forwardly recessed region 13 bordered from above by a shoulder 15. The front wall 21 of the lower pocket has a cammed interior surface 23.

Figure 2:
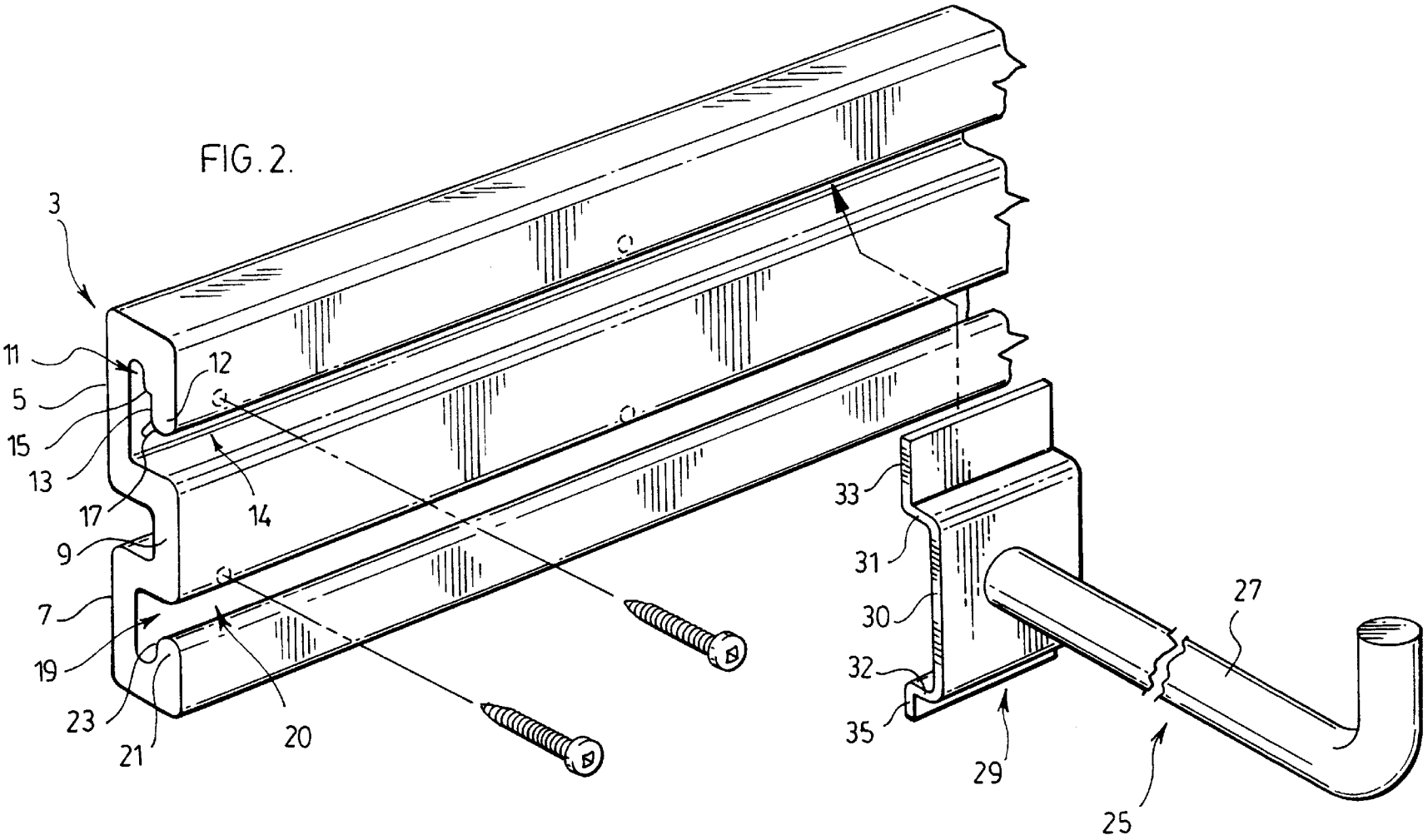
FIG. 2 is an exploded perspective view of the assembly of FIG. 1 ready for mounting to a supporting wall.

FIGS. 2 through 4 of the drawings show the hook attachment 25 as comprising a hook arm 27 and a hook base generally indicated at 29. This base, as noted above, will be consistent for any attachment added to the support.

The hook base 29 includes a vertically extending upper foot 33 and a vertically extending lower foot 35. A rectangular U-shaped wall portion 30 having an upper wall 31 and a lower wall 32 is provided between the upper and lower legs 33 and 35.

The key to the present invention is that once the support 3 has been mounted to the wall, hook 25 or any other attachment can be loaded directly at any desired position lengthwise of without having to slide along the support. Furthermore, once the attachment is loaded with the support, the attachment is blocked against easily releasing from or sliding along the support.

FIG. 3 shows that the first step in loading the base 29 of the hook comprises sliding the upper base leg 33 upwardly into the deepest part of the undercut region in the upper pocket 11 of the support. This positions the lower base leg 35 directly in front of the mouth 20 to the lower pocket 19. From here, the lower base leg is pushed into the lower pocket and then the entire base of the hook is slid downwardly relative to the support. As this occurs, the lower base leg 35 rides along cam surface 23 of the lower pocket leg 21 causing the lower base leg to move rearwardly. At the same time, the wall portion 30 of the hook base abuts against the wall portion 9 of the support which produces a rocking movement on the hook base. This rocking movement causes the upper base leg 33 to pitch forwardly against surface 13 of the upper pocket leg 12 as the base is being slid downwardly. As will be clearly seen in FIG. 4 of the drawings, when the upper base leg 33 has been tipped completely forwardly onto surface 13, it sits below and against shoulder 15 in the upper pocket leg 12.

It should be noted that the fully secured fitting of the hook base as described immediately above is reinforced by any weight placed on the hook arm 27 which only tends to enhance the forward rocking motion of the upper leg of the hook base.

As will be appreciated from FIG. 4, once the upper base leg is engaged beneath shoulder 15, the hook base is blocked against releasing from the wall support. In addition, the front wall 29 of the lower pocket continues to apply pressure in a rearward direction on the lower base leg to hold the upper base leg in the blocked position even without weight on the hook arm. Accordingly, it requires a very deliberate upward pushing movement on the hook arm to release the base from the support.

Here it should be noted that the particular combination of plastic foam in the support and metal in the hook base ensures that the harder upper leg of the hook base is able to push its way past the more resilient blocking shoulder of the foam support. Furthermore, the foam support will then have a tendency to grip onto and hold the upper base leg in its forwardly tipped position.

Another feature to be noted from the drawings is that the forward U-shaped region 30 of the hook base is taller than the U-shaped region 9 of the wall support. Accordingly, the upper wall 31 of the hook base 30 sits on an upper wall surface 10 of the wall support portion 9 while the lower wall 32 of the hook base sits directly atop the front wall 21 of the lower pocket. This arrangement substantially enhances weight bearing capacity of the hook because of the many points of support with the wall mount. However, the increased length of the U-shaped region 30 in the hook base relative to the U-shape region 9 in the support enables vertical sliding in both the up and down direction for loading and unloading the hook base from the support.

As a further feature of the invention, the drawings show a rib or fin 17 which is provided lengthwise along the interior surface of the upper pocket 12. This rib or fin, which is made from a softer vinyl material and coextruded with the more rigid main body of the support frictionally engages the upper leg of the hook base. This in turn provides a significant resistance to the hook sliding along the support. Therefore, the hook is both loaded directly at and held from moving away from a specific desired location of the wall support.

Although various preferred embodiments of the present invention have been described in detail, it will be appreciated by those skilled in the art, that variations may be made without departing from the spirit of the invention or the scope of the appended claims.

The embodiments of the invention in which an exclusive property or privilege is claimed are defined as follows:

1. An assembly comprising a wall mountable support and an attachment which is held by said support, said attachment having a base with upper and lower legs which slide vertically into an attachment mounting position with upper and lower leg receivers of said support, said base then being rockable relative to said support to position said base against blocking means which is provided in said upper leg receiver and which blocks release of said base from said support.

2. An assembly as claimed in claim 1, wherein said support is made from a rigid PVC foam material.

3. An assembly as claimed in claim 2, wherein said attachment including said base thereof is made from a metallic material.

4. An assembly as claimed in claim 2, wherein said leg receivers of said support comprise upper and lower pockets, each pocket having a mouth which opens to an undercut region in each pocket.

5. An assembly as claimed in claim 4, wherein the undercut region in the upper pocket is deeper than the length of the upper leg of the base which allows upward movement of the upper leg while contained within the upper pocket enabling the lower leg to be fitted into the lower pocket through the mouth thereof.

6. An assembly as claimed in claim 5, wherein the base is movable downwardly relative to said support while said upper and lower legs are contained within said upper and lower pockets, said lower pocket including a cam surface which acts against said lower leg while said lower leg is moved downwardly within said lower pocket, said cam surface rocking said base against said blocking means.

7. An assembly as claimed in claim 6, wherein said blocking means comprises a shoulder within said upper pocket, said upper leg of said base being tipped forwardly beneath said shoulder when said base is rocked by said cam surface.

8. An assembly as claimed in claim 4, wherein said rigid foam material is extruded to form said support, said support having a coextrusion of softer vinyl material provided lengthwise thereof within one of said pockets, said softer vinyl material acting against and resisting horizontal sliding of the base along said support.

* * * * *